US005501763A

United States Patent [19]

Ueda et al.

[11] Patent Number: 5,501,763

[45] Date of Patent: Mar. 26, 1996

[54] TAPE JOINING APPARATUS

[75] Inventors: Michio Ueda, Tokushima; Akio Suzuki, Tokyo; Yoshiro Suenaga, Tokyo; Takayuki Ishikawa, Tokyo, all of Japan

[73] Assignee: Shikoku Kakoki Co., Ltd., Tokushima, Japan

[21] Appl. No.: 324,620

[22] Filed: Oct. 18, 1994

[30] Foreign Application Priority Data

Oct. 19, 1993 [JP] Japan ..... 5-56393 ]U

[51] Int. Cl.[6] ..... B65H 21/00

[52] U.S. Cl. ..... 156/504; 156/159; 156/507; 242/552; 242/555.2

[58] Field of Search ..... 156/157, 159, 156/502, 504, 505, 507; 242/551, 552, 554.2, 554.5, 555.2, 555

[56] References Cited

U.S. PATENT DOCUMENTS 3,939,032 2/1976 Taitel et al. ..... 156/505
4,250,692 2/1981 Uchida ..... 156/502 X
4,563,234 1/1986 Kubo ..... 156/159 X
5,288,361 2/1994 Konno ..... 156/353

FOREIGN PATENT DOCUMENTS 4-201825 7/1992 Japan .

*Primary Examiner*—Mark A. Osele
*Attorney, Agent, or Firm*—Armstrong, Westerman, Hattori, McLeland & Naughton

[57] ABSTRACT

A tape joining apparatus comprises a transport device for transporting a preceding tape via a joining station, a fixed holder disposed on one side of a path of transport of the tape at the joining station for releasably holding the leading end of a subsequent tape with an adhesive applied to the leading end so as to oppose the leading end to the preceding tape, a movable body disposed on the other side of the path and positionable at the joining station as a lower limit of stroke thereof, a movable holder supported by the movable body and movable in a direction orthogonal to the path for holding the rear end of the preceding tape at an upper limit of stroke of the body and releasing the preceding tape at the lower limit, and an assembly for pressing the movable holder against the fixed holder at the joining station. The transport device has a movable guide roller attached to the movable body for the preceding tape to be passed therearound.

8 Claims, 5 Drawing Sheets

TAPE JOINING APPARATUS

BACKGROUND OF THE INVENTION

The present invention relates to a tape joining apparatus, for example, for use with a tape comprising straw packages, i.e., straws arranged at a specified spacing and each wrapped with film, for joining the rear end of a preceding tape portion to the leading end of a subsequent tape portion so that the tape can be fed continuously to a straw attaching device for containers without interrupting the operation of the device.

For example, JP-A-201825/1992 discloses a known apparatus of the type mentioned which comprises transport means for transporting a preceding tape via a joining station, a fixed holder disposed on one side of a path of transport of the tape at the joining station for releasably holding the leading end of a subsequent tape with an adhesive applied to the leading end so as to oppose the leading end to the preceding tape, a movable holder disposed on the other side of the transport path at the joining station for releasably holding the rear end of the preceding tape, means for pressing the movable holder against the fixed holder at the joining station, and an accumulator provided downstream from the joining station for sufficiently slackening the tape to be transported.

The apparatus described essentially requires the accumulator for continuously feeding the tape, but it is favorable to dispense with the accumulator if possible.

SUMMARY OF THE INVENTION

An object of the present invention is to provide a tape joining apparatus which is adapted to continuously feed a tape without using an accumulator.

The present invention provides a tape joining apparatus which comprises transport means for transporting a preceding tape via a joining station, a fixed holder disposed on one side of a path of transport of the tape at the joining station for releasably holding the leading end of a subsequent tape with an adhesive applied to the leading end so as to oppose the leading end to the preceding tape, a movable body disposed on the other side of the tape transport path and positionable at the joining station as a lower limit of stroke thereof, a movable holder supported by the movable body and movable in a direction orthogonal to the tape transport path for holding the rear end of the preceding tape at an upper limit of stroke of the movable body and releasing the preceding tape at the lower limit of stroke of the movable body, and means for pressing the movable holder against the fixed holder at the joining station, the transport means having a movable guide roller attached to the movable body for the preceding tape to be passed therearound.

The tape joining apparatus of the invention comprises transport means for transporting a preceding tape via a joining station, a fixed holder disposed on one side of a path of transport of the tape at the joining station for releasably holding the leading end of a subsequent tape with an adhesive applied to the leading end so as to oppose the leading end to the preceding tape, a movable body disposed on the other side of the tape transport path and positionable at the joining station as a lower limit of stroke thereof, a movable holder supported by the movable body and movable in a direction orthogonal to the transport path for holding the rear end of the preceding tape at an upper limit of stroke of the movable body and releasing the preceding tape at the lower limit, and means for pressing the movable holder against the fixed holder at the joining station. Accordingly, when the movable holder, holding the rear end of the preceding tape at a position upstream from the joining station, is moved to the joining station where the leading end of the subsequent tape is held by the fixed holder, and is pressed against the fixed holder by the pressing means, the leading end of the subsequent tape is joined to the rear end of the preceding tape.

Furthermore, the transport means has a movable guide roller for the preceding tape to be passed therearound, so that when the movable body moves upstream from the joining station along with the guide roller, the tape is sufficiently slackened at the downstream side of the joining station.

The tape can therefore be fed continuously without using any accumulator.

DESCRIPTION OF THE PREFERRED EMBODIMENT

An embodiment of the present invention will be described below with reference to the drawings.

Figure 2:
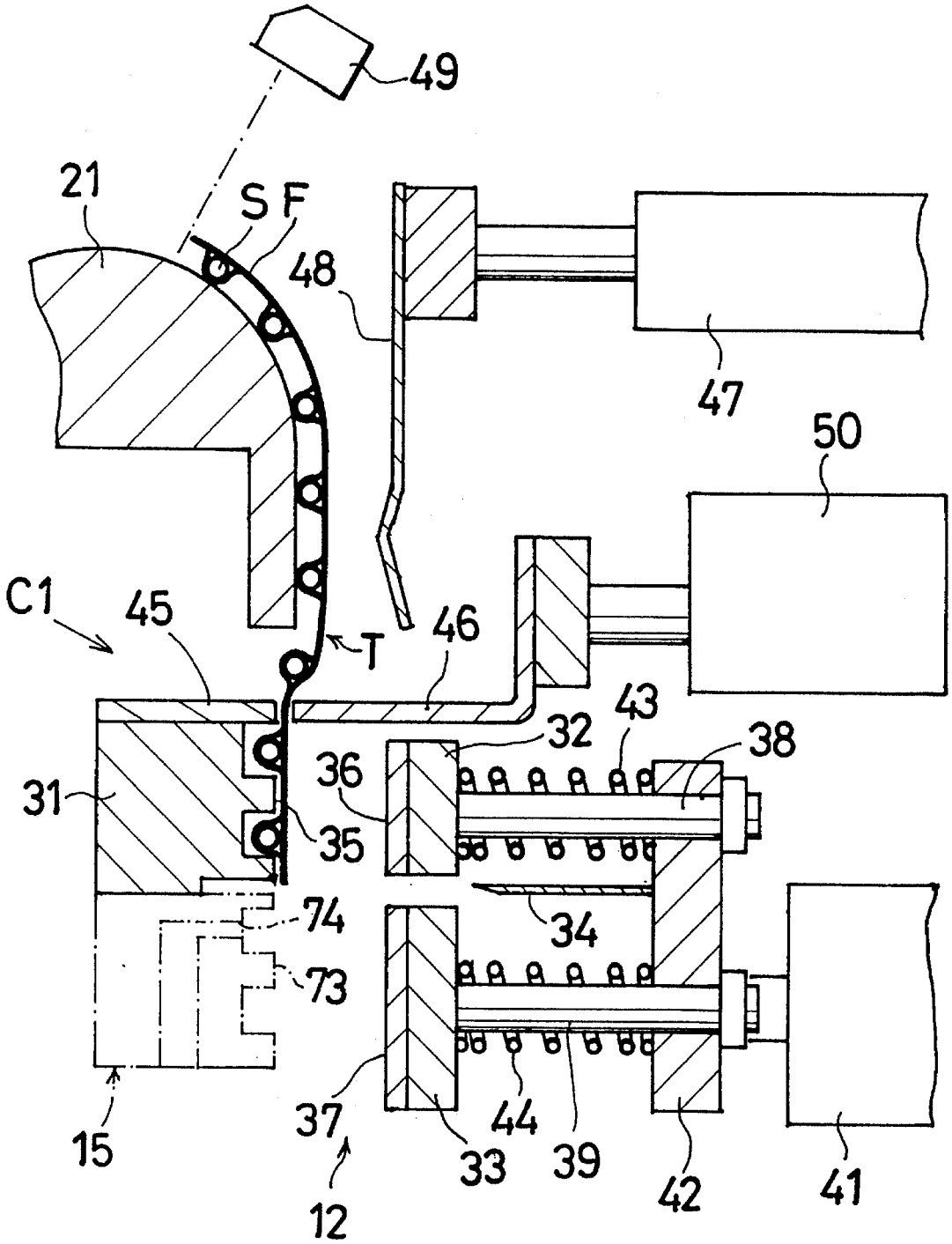
FIG. 2 is a view in vertical section of a cutter of the joining apparatus.

With reference to FIG. 2, tapes T comprise a multiplicity of straws S arranged at a specified spacing and held between two film strips F although not shown in detail.

Figure 1:
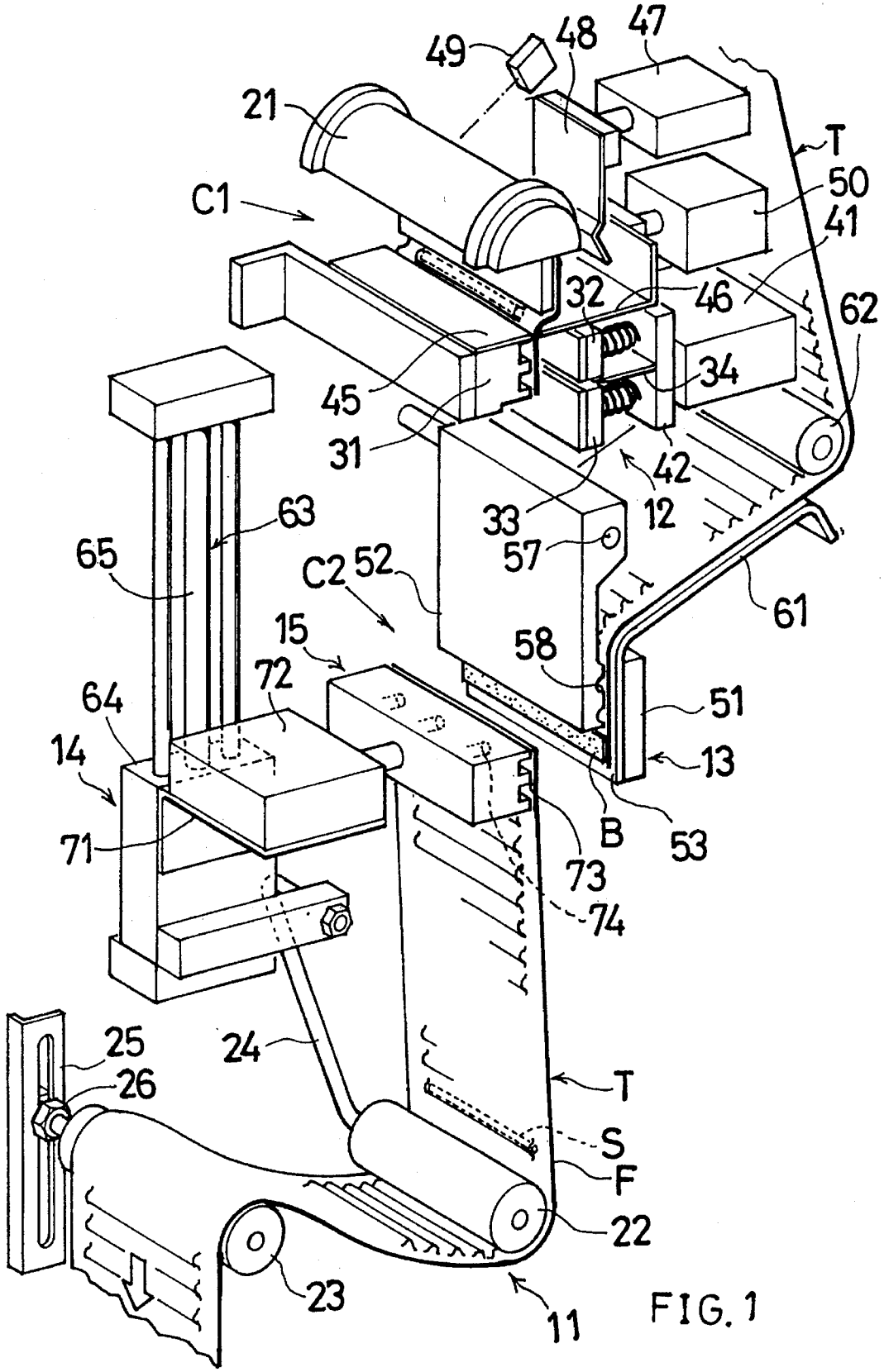
FIG. 1 is a perspective view showing a tape joining apparatus of the invention in its entirety.

FIG. 1 shows a preceding tape T being currently fed, and the subsequent tape T, the leading end of which to be joined to the rear end of the preceding tape T bears an adhesive tape B affixed thereto. Each of the preceding tape and the subsequent tape is held as wound on an unillustrated rewinder.

The illustrated tape joining apparatus comprises transport means 11 for downwardly transporting the preceding tape T via a cutting station C1 and then a joining station C2, a cutter 12 disposed at the cutting station C1, a fixed holder 13 disposed on the right side of the path of transport of the tape at the joining station C2, a body 14 movable upward and downward, provided at the left side of the transport path and positionable at the cutting station C1 as the upper limit of its stroke and at the joining station C2 as the lower limit of its stroke, and a movable holder 15 supported by the movable body 14 and movable transversely of the path.

The transport means 11 has a fixed guide member 21 disposed above the cutting station C1, and a movable guide roller 22 and a fixed guide roller which are arranged below the joining station C2 and laterally spaced apart from each other.

The movable guide roller 22 is mounted on the forward end of a swing arm 24 attached to the movable body 14. The fixed guide roller 23 is attached to a level adjusting member 26 upwardly or downwardly movable along a vertical guide rail 25.

As shown in detail in FIG. 2, the cutter 12 comprises a bearing member 31 disposed on the left side of the tape transport path, a pair of upper and lower holding members 32, 33 arranged on the right side of the path and vertically spaced apart, and a cutting blade 34 provided between the two holding members 32, 33. The bearing member 31 has a vertical bearing face 35 facing to the right and formed with furrows corresponding to the projections of the tape T due to the presence of straws. The holding members 32, 33 have flat holding faces 36, 37 facing to the left and flush with each other. The holding members 32, 33 are provided with horizontal retractable rods 38, 39 projecting rightward therefrom. These rods 38, 39 extend through a vertical pressure plate 42 attached to the rod of a fluid pressure cylinder 41 directed leftward. Provided between the pressure plate 42 and the two holding members 32, 33 are compression springs 43, 44 surrounding the respective rods 38, 39. The cutter blade 34 is in the form of a horizontal plate and is secured to and projects leftward from the pressure plate 42.

A stationary engaging plate 45 is attached to the upper side of the bearing member 31 and has one end projecting rightward beyond the bearing face 35. A movable engaging plate 46 attached to the piston rod of a fluid pressure cylinder 50 which is directed leftward is disposed on the other side of the transport path opposite to the stationary engaging plate 45 and has a forward end opposed to the plate 45.

Provided immediately above the movable engaging plate 46 is a movable tape holder 48 attached to the piston rod of a fluid pressure cylinder 47 which is directed leftward. A tape rear end sensor 49 is further provided above the tape holder 48.

With reference to FIG. 1 again, the fixed holder 13 has a bearing member 51 and a holding member 52. The bearing member 51 is in the form of a vertical plate having a vertical bearing face 53 facing to the left and has a vertical support plate 54 projecting rightward (see FIG. 3). The support plate 54 is held at its upper and lower edges between a pair of upper and lower horizontal guide rails 55. The support plate 54 is provided with a clamp 56. The holding member 52, which is in the form of a flat plate, is pivotably suspended by a horizontal pin 57 and has a holding face 58 facing to the right and lapping over an upper portion of the bearing face 53. The holding face 58 is formed with furrows or projections like the cutter bearing face 35. An inclined guide plate 61 extends from the upper end of the bearing member 51 upwardly rightward. A guide roller 62 is disposed obliquely rightwardly above the upper end of the guide plate 61.

The movable body 14 comprises the body 64 of a rodless cylinder 63. The cylinder has a vertical cylinder tube 65.

The movable holder 15 is in the form of a horizontal rectangular parallelepiped attached to the piston rod of a fluid pressure cylinder 72, which is directed toward the right and mounted by a bracket 71 on the cylinder body 64. The holder 15 has a vertical pressure face 73 facing to the right and formed with furrows or projections like the holding face 58. A multiplicity of dispersed suction ports 74 are formed in the pressure face 73.

Figure 3:
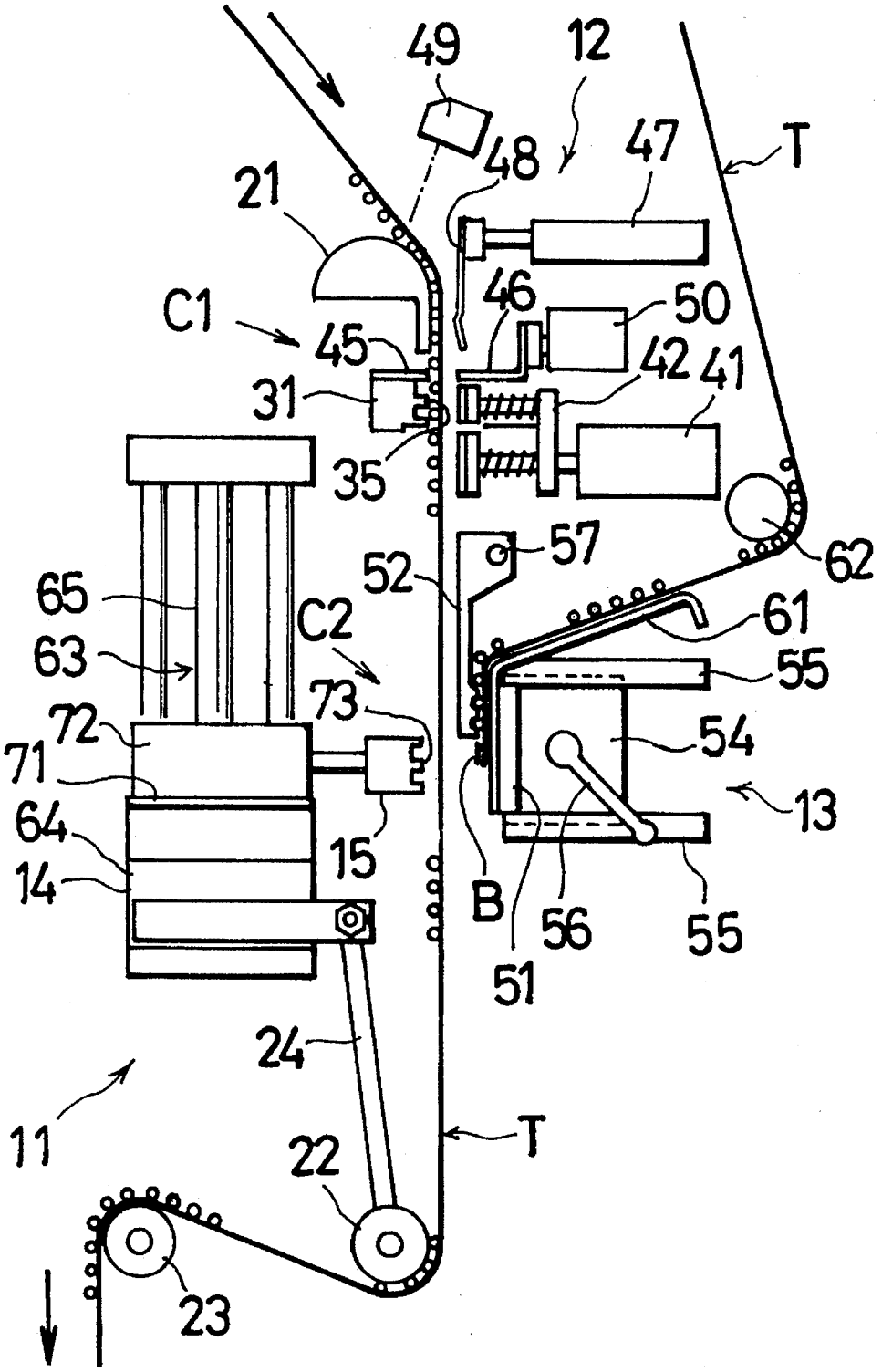
FIG. 3 is a diagram for illustrating movements involved in a tape joining operation.

With reference to FIG. 3, the preceding tape T is passed around the guide member 21, movable guide roller 22 and fixed guide roller 23 in succession.

The subsequent tape T is guided first by the guide roller 62 and then by the guide plate 61 to the position of the fixed holder 13, where the tape is held between the holding member 52 and the bearing member 51 with the adhesive tape B projecting downward beyond the holding member 52, whereby the tape is retained by the fixed holder 13.

When the quantity of the preceding tape T remaining has diminished, the diminution is detected by a sensor (not shown), and the tape holder 48 is actuated by the resulting detection signal. The holder tensions the tape T to a specified extent even when the rear end of the tape T has left the rewinder by being paid off.

Figure 4:
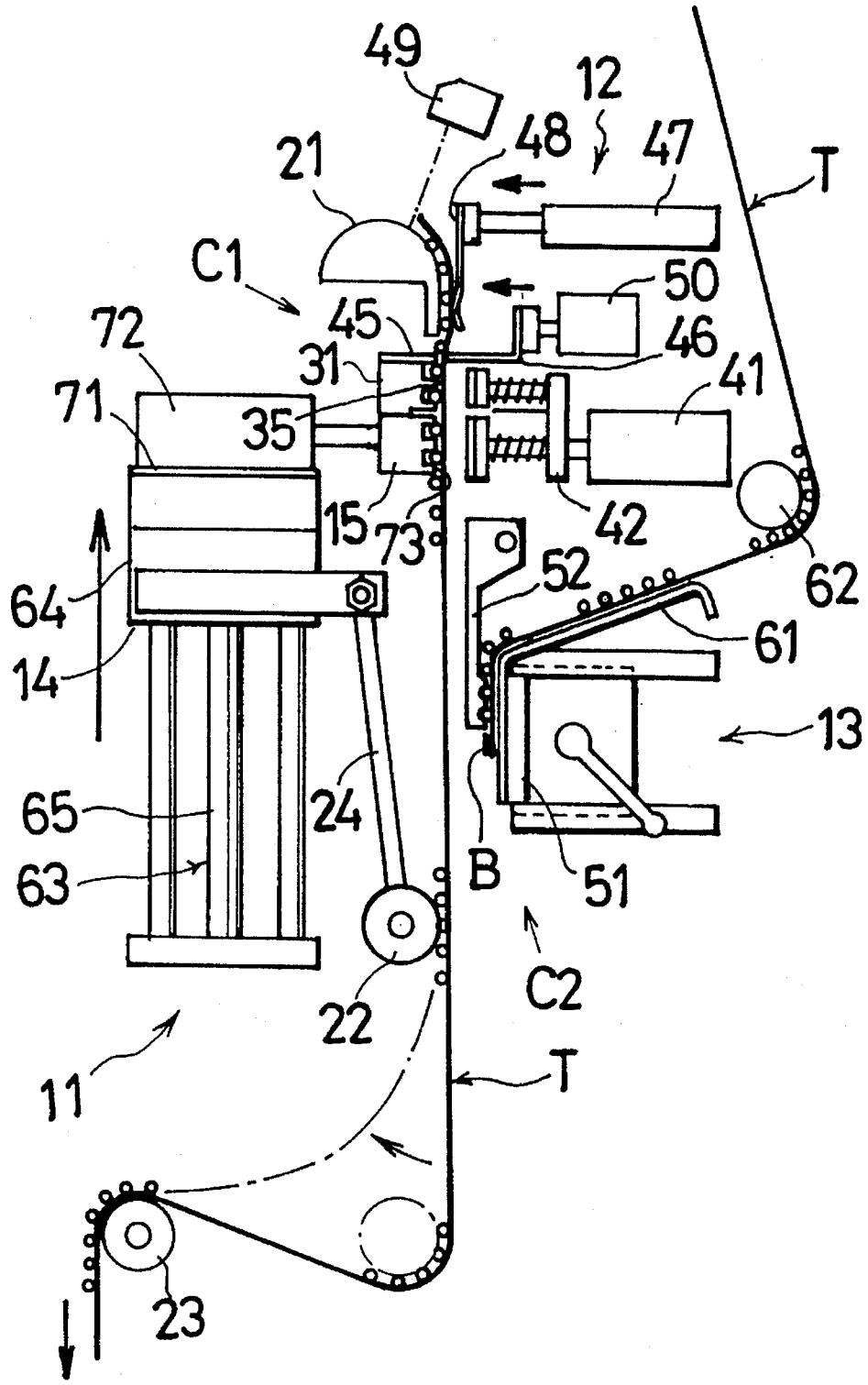
FIG. 4 is a diagram for illustrating movements of the operation subsequent to those of FIG. 3.

FIG. 4 shows the rear end of the preceding tape T as transported to the position of the tape rear end sensor 49. Upon detecting the tape end, the sensor 49 produces a detection signal, in response to which the movable engaging plate 46 is actuated. Before or after this, the movable body 14 is raised. Upon the actuation of the movable engaging plate 46, the preceding tape T is nipped between the stationary engaging plate 45 and the plate 46 with one of the straws S in engagement with the plates 45, 46, whereby the tape T is positioned in place. Upon the rise of the movable body 14 to its upper limit, the bearing face 35 of the cutter 12 becomes flush with the pressure face 73 of the movable holder 15.

With the rise of the movable body 14, the movable guide roller 22 is raised with the body 14, slackening the tape T which has been tensioned. The tape T can be fed forward continuously until the slack is removed. The amount of slack in the tape T is variable by altering the level of the fixed guide roller 23. The amount of slack in the tape T is adjusted depending on the type of tape, feed speed of the tape, etc.

Figure 5:
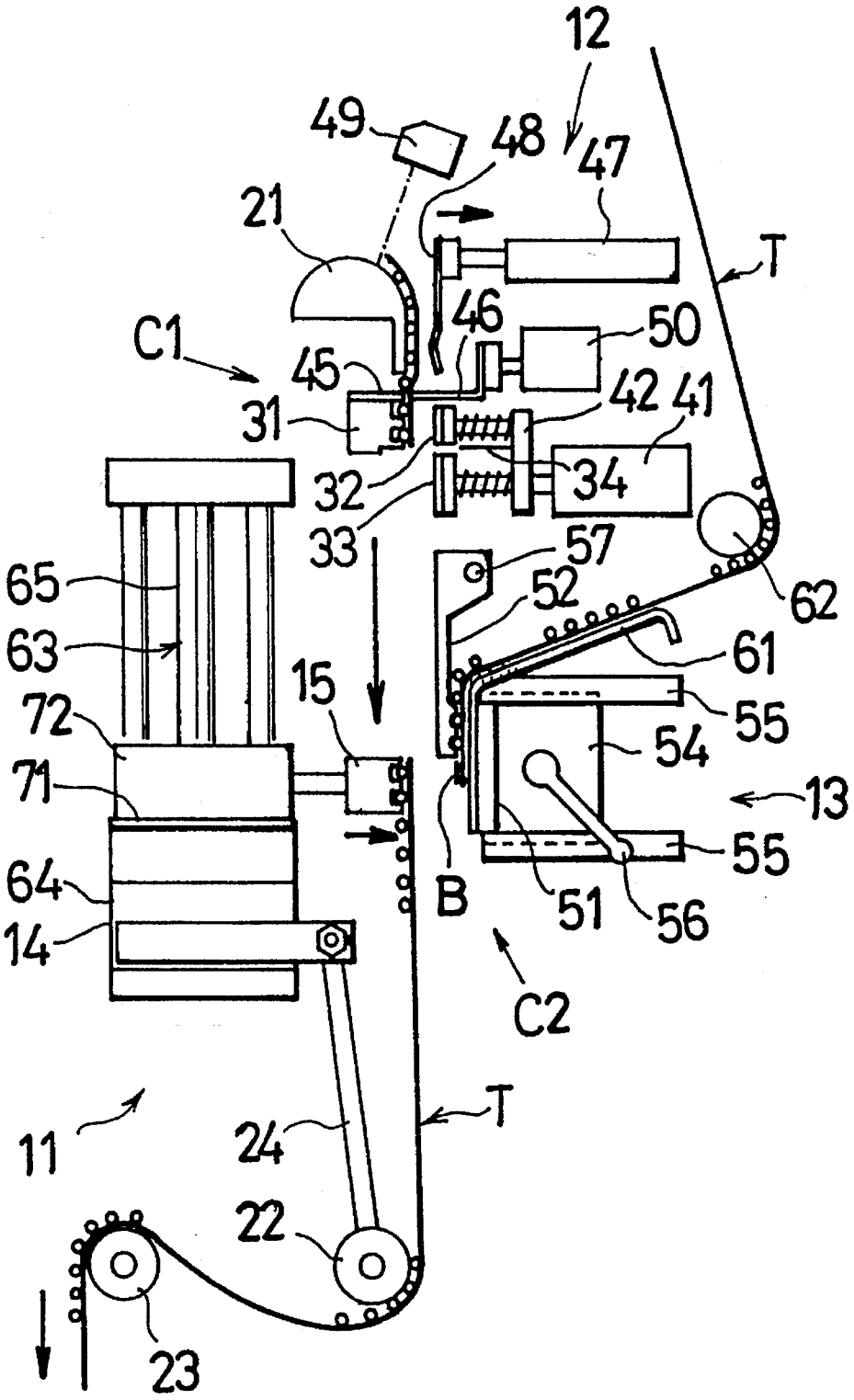
FIG. 5 is a diagram for illustrating movements of the operation subsequent to those of FIG. 4.

As shown in FIG. 5, the tape T is cut with the cutter blade 34 by operating the holding members 32, 33 of the cutter 12 along with the blade 34, i.e., by pressing the holding members 32, 33 against the bearing member 31 and thereafter moving the cutting blade 34 further leftward to insert the edge of the blade 34 into a clearance between the bearing member 31 and the movable holder 15.

The movable body 14 lowers with the cut tape T held to the movable holder 15 by suction. When the body 14 is lowered to its lower limit, the movable holder 15 is moved rightward and pressed against the bearing member 51 of the fixed holder 13 with the rear end of the held preceding tape T and the leading end of the subsequent tape T positioned therebetween, whereby the rear end of the preceding tape T is joined to the leading end of the subsequent tape T.

Upon completion of joining of the tapes T, the tape holder 48 and the movable engaging plate 46 are brought out of operation,whereupon the cut-off remaining tape portion falls and is thereby removed.

Finally, the clamp 56 is loosened and the support plate 54 is moved rightward to form a clearance between the holding member 52 and the bearing member 51. The subsequent tape T as joined to the preceding tape T is moved through the clearance into the path of travel of the preceding tape for feeding, and the fixed holder 13 is caused to hold the subsequent tape T to be fed next.

What is claimed is:

1. A tape joining apparatus for joining the rear end of a preceding tape to the leading end of a subsequent tape, the apparatus comprising:

transport means for transporting the preceding tape via a joining station, a fixed holder disposed on one side of a path of transport of the tape at the joining station for releasably holding the leading end of the subsequent tape with an adhesive applied to the leading end so as to oppose the leading end to the preceding tape, a movable body disposed on the other side of the tape transport path and positionable at the joining station as a lower limit of stroke thereof, a movable holder supported by the movable body and movable in a direction orthogonal to the tape transport path for holding the rear end of the preceding tape at an upper limit of stroke of the movable body and releasing the preceding tape at the lower limit of stroke of the movable body, and means for pressing the movable holder against the fixed holder at the joining station, the transport means having a movable guide roller attached to the movable body for the preceding tape to be passed therearound.

2. A tape joining apparatus as defined in claim 1 wherein the fixed holder comprises a bearing member and a holding member opposed to each other for holding the adhesive-bearing leading end of the subsequent tape therebetween, a support member supporting the bearing member movably toward or away from the holding member and clamp means for clamping the support member in a desired position.

3. A tape joining apparatus as defined in claim 1 wherein the movable body comprises a rodless cylinder body.

4. A tape joining apparatus as defined in claim 1 wherein the pressing means comprises a fluid pressure cylinder mounted on the movable body and having a piston rod fixed to the movable holder.

5. A tape joining apparatus as defined in claim 1 wherein a cutting station is provided at the upper limit of stroke of the movable body, and a cutter is disposed at the cutting station for cutting off an unnecessary rear end portion of the preceding tape.

6. A tape joining apparatus as defined in claim 5 wherein the cutter comprises a bearing member disposed alongside the movable holder thereabove when the movable body is positioned at the upper limit of its stroke, a first holding member disposed as opposed to the cutter bearing member with the tape transport path at the cutting station interposed therebetween, a second holding member disposed alongside the first holding member at a specified distance therefrom so as to be opposed to the movable holder with the tape transport path interposed therebetween when the movable body is at the upper limit, and a cutting blade interposed between the first and second holding members.

7. A tape joining apparatus as defined in claim 5 wherein a tape holder is disposed upstream from the cutting station for tensioning the tape when it is to be cut.

8. A tape joining apparatus as defined in claim 1 wherein a movable guide roller is mounted on a forward end of an arm extending downstream from the movable body, and a fixed guide roller is spaced apart from the movable guide roller by a specified distance in a direction orthogonal to the direction of movement of the movable guide roller, the fixed guide roller being movable in the direction of movement of the movable guide roller and provided with position adjusting means.

* * * * *